United States Patent [19]

Campin et al.

[11] Patent Number: 4,727,732

[45] Date of Patent: Mar. 1, 1988

[54] DEVICE FOR DETECTING THE PRESENCE OF AN INDIVIDUAL YARN IN A LAP OF PARALLEL YARNS

[76] Inventors: Pierre G. Campin, 3 avenue du Sud, 94110 Le Perreux; Jean P. Dumas, 6, bis rue Le Serrurier, 02100 Saint Quentin; Michel Gre, 121 rue de Monly, 69230 Saint Gents Laval; Alain Legay, 18 chemin de la Creuse, 07100 Annonay; André Langlet, 38 rue Calixte Souplet, 02100 Saint Quentin; Yvon Madec, 33 rue du Poitou, 02100 Saint Quentin, all of France

[21] Appl. No.: 14,730

[22] Filed: Feb. 13, 1987

[30] Foreign Application Priority Data

Feb. 13, 1986 [FR] France ..... 86 02118

[51] Int. Cl.[4] ..... D04B 35/26

[52] U.S. Cl. ..... 66/163

[58] Field of Search ..... 66/157, 158, 163

[56] References Cited

U.S. PATENT DOCUMENTS

| | | | |
|---|---|---|---|
| 3,530,690 | 3/1968 | Nickell et al. . | |
| 3,575,515 | 4/1971 | Fertig | 66/163 |
| 3,628,030 | 12/1971 | Fertig et al. | 66/163 |
| 3,677,307 | 7/1972 | Fiorucci | 66/163 |
| 3,738,124 | 6/1973 | Reynolds | 66/163 |
| 4,364,247 | 12/1982 | Muns-Magemetal | 66/163 |
| 4,444,132 | 4/1984 | Breitenbach | 66/163 |
| 4,549,413 | 10/1985 | Flamig | 66/163 |

FOREIGN PATENT DOCUMENTS

| | | |
|---|---|---|
| 1951916 | 4/1971 | Fed. Rep. of Germany . |
| 2034815 | 1/1972 | Fed. Rep. of Germany . |

*Primary Examiner*—Ronald Feldbaum

*Attorney, Agent, or Firm*—Bruns and Wall

[57] ABSTRACT

This invention relates to a device for detecting the presence of an individual yarn in an advancing lap of parallel yarns, constituted by: detector disposed on one side and in the vicinity of this advancing lap, adapted to detect the presence of a yarn moved away from the lap by a blower means disposed on the other side of said lap; an arrangement, controlled by the detector, for stopping the advancing lap or for triggering off an alarm system, wherein: it is composed, in known manner, of a plurality of parallel comb teeth, between which the advancing yarns pass; and the blower is placed at the base of said teeth and directs the flow of air towards the tip of these teeth. The invention is more particularly applicable to warp knitting machines.

6 Claims, 4 Drawing Figures

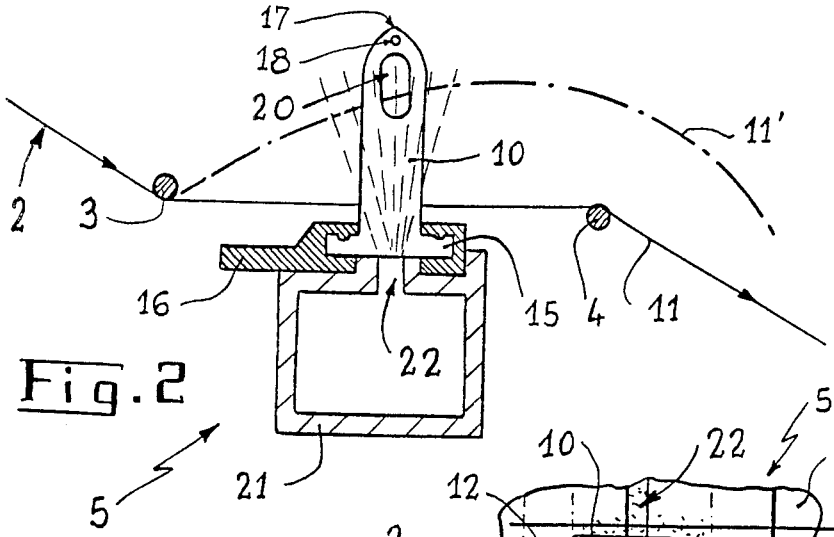
Fig. 2
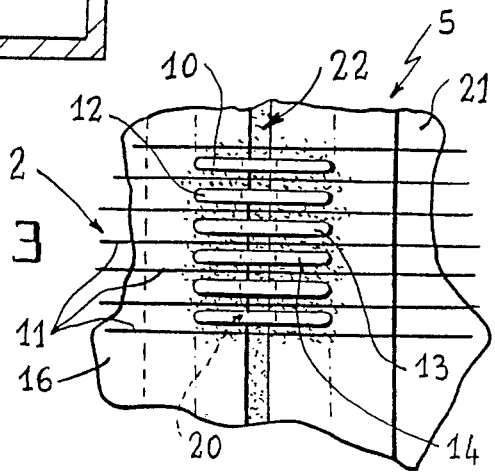
Fig. 3
Fig. 4
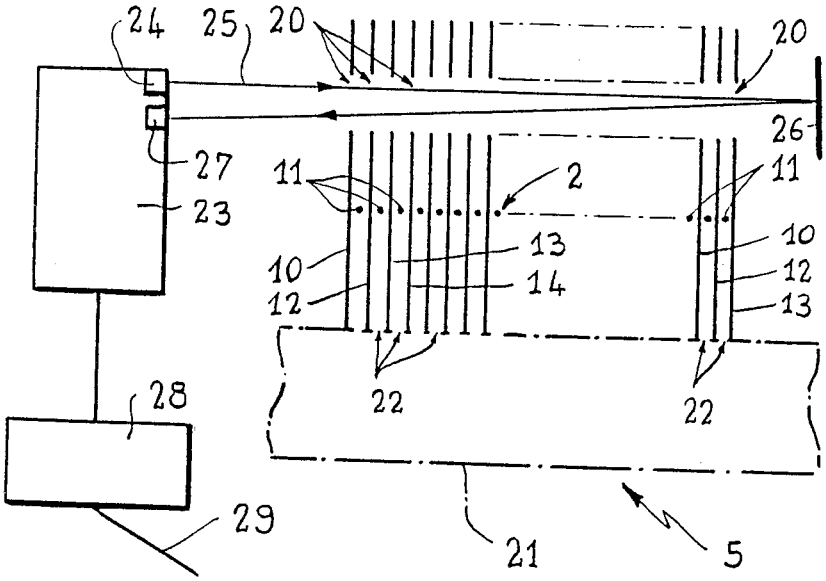

DEVICE FOR DETECTING THE PRESENCE OF AN INDIVIDUAL YARN IN A LAP OF PARALLEL YARNS

The present invention relates to a novel type of detector for detecting the presence of an individual yarn in a lap of parallel yarns and more particularly in a warp knitting machine; it also relates to the machines comprising such detectors.

In an advancing lap of parallel yarns, it is indispensable to be able, with precision:

on the one hand, to detect the presence or absence of each elementary yarn;

on the other hand, correlatively, immediately to stop the machine or give a warning.

A yarn detector, sometimes also incorrectly called a "thread-catch" device, is therefore called upon:

firstly, not to unravel the yarn which is advancing, nor to modify the tension thereof;

then to have as low an inertia as possible, so as to be able rapidly to actuate the members for stopping the machine, at least before the defect detected has arrived at the working members (needles, heddles, etc. . . . );

finally, to be of small dimensions, sensitive to low tensions, i.e. to tensions of the order of a gram, which, nonetheless, may fluctuate about this value.

Up to the present time, two ways of detecting the presence of a yarn in an advancing lap are essentially proposed.

It has firstly been proposed to effect detection on each individual yarn. This solution is sought after from the technical standpoint, as it should give precise results. Nevertheless, despite all the efforts and the large number of solutions proposed up to the present, none has yet really proved satisfactory, this clearly demonstrating the difficulty of the problem to be solved.

It has also been proposed to effect this detection, no longer on the individual yarns themselves, but on the lap itself. It has for example been suggested to dispose, in the vicinity of the advancing lap, a light beam such as an optical ray which, when it is traversed by the slack or broken yarn, triggers off the system for stopping the knitting machine. However, this solution necessitates the use of an additional blower, disposed on the rear face of the advancing lap, with respect to the light beam, so as to move away the broken or slack yarns of the advancing lap and thus to lead them to traverse the light beam. This solution, which is, moreover, exploited, has proved in practice to be of contestable reliability, with high operational costs and, especially, necessitates the application of an appreciable blowing force in order to displace the slack yarn. Frequently, multiple accidents cannot be detected by this type of detector (cf. German Pat. No. DE-A-2 034 815).

As has already been stated, despite a multitude of solutions proposed, none of these solutions has proved satisfactory up to the present time for the detection of the presence of a yarn in an advancing lap of parallel yarns, particularly with a low tension.

It is an object of the present invention to overcome these drawbacks by producing a detection device of the latter type in question, which is efficient, of small dimensions, sensitive, does not unravel the yarn, does not modify its tension, presents a low inertia, is operational in the majority of the positions, which could not be obtained industrially heretofore, and, finally, is economical to construct, to mount, to operate and, finally, does not complicate the path of the yarn.

This device for detecting the presence of an individual yarn in a lap of parallel yarns, of the type constituted by:

means for advancing the lap of parallel yarns;

a means disposed on one side and in the vicinity of this advancing lap, adapted to detect the presence of a yarn moved away from the lap by a blowing means disposed on the other side of said lap;

a means, actuated by the detection means, for stopping the advancing means or for triggering off an alarm system, is characterized in that:

it is composed in known manner of a plurality of parallel comb teeth, between which the advancing yarns pass;

and the blowing means is placed at the base of said teeth and directs the flow of air towards the tip of these teeth.

In other words, the invention consists in employing comb teeth which, in known manner, serve to space each yarn regularly, but also, and this is novel, serve to channel the air flow blown at the base of the teeth and thus to displace the slack or broken yarn towards the detection means, this with a force which is sufficient, although generated by a small flow of air. In this way, not only the compressed air intended for displacing the yarn is substantially economized, but also the probability of detection is considerably increased.

Advantageously, in practice:

the characteristic teeth comprise a window placed in the zone located towards the tip of the tooth and the detection means is directed through this window;

the detection means is constituted:

either, preferably, by a light beam, parallel to the plane of the lap and at right angles to the advancing yarns, disposed in the vicinity of the tip of the teeth and which, preferably, passes through the windows made therein, or by a detector wire, disposed in the same manner, but taken to a high electric potential or traversed by a high-frequency current, with the result that this wire, under the effect of a contact with a textile yarn to be monitored, slack or broken, is discharged, in order thus to stop the machine or to trigger off the alarm system;

the light ray passes through windows made in the teeth, then is picked up by a member such as a photosensitive receiver lens, either directly or after reflection and passage again through said windows; this receiver member is associated with the means for controlling the stop of the machine or the triggering of the alarm signal;

the space between teeth just allows passage of a knot in order to reduce to a maximum the necessary flowrate of air and to channel the flow towards the tip of the teeth;

the detector device of the invention simultaneously forms a divider comb for a warp knitting machine.

In a variant embodiment, the teeth are solid and the incident and reflected beams of the detection member or the detector wire are either on the same side of the tooth or on either side thereof, but above the plane of the lap.

The invention will be more readily understood on reading the following description with reference to the accompanying drawings, in which:

FIG. 2 is a view in section of the detection device according to the invention.

FIG. 3 is a plan view showing the succession of the characteristic parallel teeth.

FIG. 4 is a summary representation of an improved version of a detector device of the invention.

Figure 1:
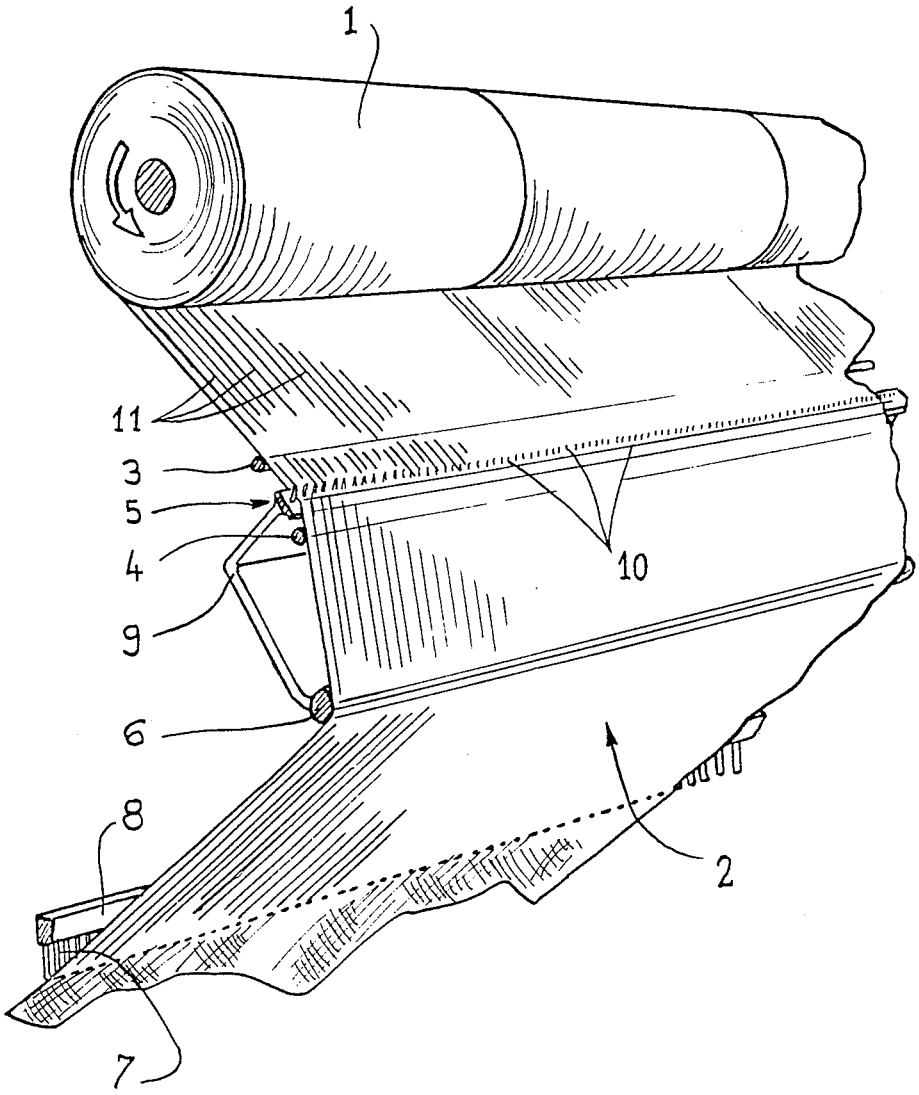
FIG. 1 is a summary perspective view of the functional part, for the invention, of a warp knitting machine.

Referring now to the drawings, as is known (cf. FIG. 1), a warp knitting machine is composed of two or more beams 1 from which unwind laps of parallel yarns 2 passing respectively in order over two rolls 3 and 4 between which is disposed a divider comb 5. The lap then passes over a tension bar 6, then arrives from there to hooks 7 of the hook bar 8, to be knitted. The whole is fast with the frame of the machine.

According to the feature of the invention, the divider comb 5 comprises a plurality of teeth 10 regularly spaced apart as a function of the gauge of the dimension of a knot and parallel to one another. Each individual yarn designated by reference 11 passes between two successive teeth 10, 12, 13, 14 (cf. FIG. 3). In this way, in known manner, the teeth position the yarns with respect to one another in order to avoid their being mixed during advance.

According to the feature of the invention, the teeth 10, 12, 13, 14 are fixed by their base 15 in a common block 16 with several teeth, forming comb-holder, for example made of plastics material or lead. The teeth 10, made of steel plate or any other abrasion-resistant metal, comprise in known manner at their tips 17 a small orifice 18 through which passes a steel wire intended to facilitate positioning of the yarns 11 between the teeth during threading.

According to the invention, each comb tooth 10 presents:

on the one hand, in the vicinity of tip 17, a window 20;

on the other hand, at the base 15, a nozzle adapted to direct a flow of compressed air towards the tip 17 of each of the teeth.

To this end, the comb-holder 16 is mounted on tubular support 21 supplied with compressed air, at a pressure for example of the order of one to several decimetres of water column. This support 21 is split over the whole of its length and this slit constitutes with teeth 12, 13 of the comb the inter-teeth blowing nozzle. This characteristic opening 22 is as small as possible, and channels all the flow of air represented by dotted lines towards the tip 17 of teeth 10 and more precisely towards window 20. It is this flow which displaces the broken or slack yarn 11 and causes it to energize the detector.

According to a feature of the invention, the detection system comprises a box 23 comprising a diode (or a laser) adapted to emit through a projection lens 24 a light ray 25 which thus passes through the tunnel formed by all the windows 20 of the successive parallel teeth 10–14. When this light ray 25 has passed through all the slots 20, it arrives on a mirror 26, for example of the reflector type, to be reflected and pass through these same windows 20 again and come onto another lens 27 associated with a receiver. The system comprises a signal amplifier 28 itself associated with the control 29 of the stop of the knitting machine or of the alarm system.

When a yarn 11 is slack or broken, under the effect of the air flow which passes through the opening 22 and which is directed towards window 20, this broken or slack yarn 11 is lifted, then passes in front of window 20 and thus interrupts the light beam 25. This interruption detected and the signal amplified by 28 triggers off at 29 either the stop of the machine or an alarm system.

In an advantageous variant, the nozzle 22 is not disposed exactly beneath the tooth but in the immediate vicinity thereof and as provided in the definition at its base. As before, the air flow is directed towards the tip of the tooth. This solution avoids soiling of the nozzle and of the gap between two teeth.

In another variant, the light beam 25 is no longer reflected at 26 but is detected directly by a call similar to 27 disposed instead and in place of the mirror 26. This solution is more adapted to large-width knitting machines, i.e. with a width of 2.50 m and more.

Finally, as already stated, the light beam or the detector wire may be disposed in the immediate vicinity of the tip of the teeth and slightly outside. This solution enables combs with standard teeth to be used.

The system according to the invention for detecting the presence of an individual yarn presents numerous advantages over the systems marketed heretofore. For example:

with respect to the device mentioned in the preamble with light ray:

its simple construction, increased probability of detection;

with respect to the mechanical detector:

the absence of additional problem of threading, since the device replaces the existing divider comb, easy assembly on the machine by simple replacement of the conventional comb 5, the absence of modification of the path of the yarn, therefore absence of increase in the tensions, no increase in manpower costs;

and a compensation of the sub-tensions produced in particular on the selvedge yarns, this allowing excellent regularization of the selvedge tensions, which was not economically obtainable up to the present time.

Consequently, these devices may be successfully used not only in warp knitting machines, but also in all other devices in which the advancing laps of parallel yarns must be monitored, such as weaving looms, beams, sizing machines, warping machines.

What is claimed is:

1. A device for detecting the presence of a yarn in a lap of parallel yarns, comprising:

advancing means for advancing the lap of parallel yarns;

detecting means disposed to one side of, and in the vicinity of the advancing lap, for detecting the presence of a yarn moved away from the lap;

blowing means disposed to the other side of said lap for blowing against the lap of yarns;

means controlled by the detecting means for stopping the advancing means or for triggering off an alarm system; and a comb comprising a plurality of parallel teeth spaced apart by the dimension of a knot, between which the advancing yarns pass to space the yarns regularly;

wherein said blowing means is situated at the base of said comb and includes means to direct the flow of air towards the tip of the teeth and to channel the air flow between each pair of adjacent teeth towards the tip of the teeth.

2. The detection device of claim 1 wherein the teeth each have a window placed in the zone located between the lap of the yarn and the tip of the tooth, the windows being in alignment, and the detecting means is directed through these aligned windows.

3. The detection device of claim 1 wherein the detecting means is constituted by an electrostatically charged wire disposed in the vicinity of the tips of the teeth.

4. The detection device of claim 1 wherein the detection means includes means to generate a light beam parallel to the plane of the lap and passing through a tunnel formed of aligned windows in the successive teeth.

5. The detection device of claim 3 wherein the detection means includes reflecting means for reflecting the light beam back through said tunnel and receiver means situated on the opposite side of the comb from said reflecting means for receiving the reflected light beam, and providing an output signal to the means for stopping the advancing means or for triggering off the alarm system.

6. The detection device of claim 1 wherein said comb further serves as the divider of a warp knitting machine.

* * * * *